US006561628B1

(12) United States Patent
Camis et al.

(10) Patent No.: US 6,561,628 B1
(45) Date of Patent: May 13, 2003

(54) TONER PROJECTION SYSTEM

(75) Inventors: Thomas Camis, Boise, ID (US); C. S. Chan, Boise, ID (US); Gary Hanson, Meridian, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 931 days.

(21) Appl. No.: 08/780,551

(22) Filed: Jan. 8, 1997

(51) Int. Cl.[7] ..... B41J 2/06
(52) U.S. Cl. ..... 347/55
(58) Field of Search ..... 347/55, 10, 11

(56) References Cited

U.S. PATENT DOCUMENTS 3,816,840 A * 6/1974 Kotz ..... 347/55
4,491,855 A * 1/1985 Fujii et al. ..... 346/159
5,329,307 A * 7/1994 Takemura et al. ..... 346/153
5,448,272 A * 9/1995 Kaisha ..... 347/55
5,453,768 A * 9/1995 Schmidlin ..... 347/55

* cited by examiner

*Primary Examiner*—John Barlow

(57) ABSTRACT

A system for projecting electrically conductive or semi-conductive toner directly on to print media using a direct electrostatic projection printing device that includes a projection control electrode positioned between a reference electrode and an orifice plate. A mechanism is provided for generating a first electric field between the reference electrode and the orifice plate to form a cloud of toner particles between the reference electrode and the orifice plate. A mechanism is also provided for intermittently generating a second electric field between the projection control electrode and the orifice plate to project toner particles through the orifice plate on to a sheet of paper.

14 Claims, 5 Drawing Sheets

TONER PROJECTION SYSTEM

FIELD OF THE INVENTION

The invention relates to a system for projecting electrically conductive or semi-conductive black or colored toners directly on to a print media.

BACKGROUND OF THE INVENTION

Conventional printers using dry toners typically employ electrophotographic components to create and develop the desired image on paper or other print media. In electrophotography, a latent image is created on the surface of a photoconducting material by selectively exposing areas of the surface to light. A difference in electrostatic charge density is thereby created between the exposed and unexposed areas on the surface of the photoconductor. The visible image is developed by electrostatic toners containing pigmented components which are usually dispersed in an insulating binder and transferred to the photoconductor via a toner delivery system. The photoconductor and toner particles are oppositely charged, or have different levels of the same charge, and the toner particles are electrostatically attracted to or repelled from either the exposed or unexposed areas on the surface of the photoconductor. A sheet of paper or an intermediate transfer medium is then given an electrostatic charge opposite that of the toner and passed in close proximity to the photoconductor to attract the toner from the photoconductor on to the paper or intermediate medium in the pattern of the image developed on the photoconductor.

It would be a significant advantage in the use of dry toner printers to project the dry toner from a print head directly on to the paper to form the desired images thereon. This direct projection would eliminate the need for a photoconductor and the associated indirect transfer mechanisms used in conventional electrophotographic printers. It would also be advantageous to use conductive or semi-conductive toners to help reduce the degradation of print quality caused by counter-electrostatic field forces that can act to divert toner trajectories in conventional print mechanisms. Such forces are particularly evident in dry toner color printers. The use of conductive or semi-conductive toners could also reduce or eliminate problems caused by "wrong sign" toner and make the print process less sensitive to varying levels of paper thickness and resistivity.

SUMMARY OF THE INVENTION

Accordingly, it is one object of the invention to project dry toner directly on to paper or other print media and thereby eliminate the need for a photoconductor and the associated indirect transfer mechanisms used in conventional electrophotographic printers.

It is another object to use conductive or semi-conductive toners in a direct projection printing device to help reduce the degradation of print quality caused by counter-electrostatic field forces that divert toner trajectories in conventional print mechanisms, eliminate problems caused by "wrong sign" toner, and make the print process less sensitive to varying levels of paper thickness resistivity.

It is another object of the invention to provide a new toner projection system that generates a toner cloud within a print head structure and selectively projects toner particles on to paper or other print media.

These and other objects and advantages are achieved by a novel system for projecting conductive or semi-conductive toner directly on to paper or another image receiving member. In one embodiment of the invention, a direct electrostatic projection printing device includes a reference electrode, an orifice plate and a projection control electrode interposed between the reference electrode and the orifice plate. An alternating electric field is generated between the reference electrode and the orifice plate to form a cloud of toner particles between the reference electrode and the orifice plate. An electric field is also generated intermittently between the projection control electrode and the orifice plate to project toner particles through the orifice plate on to a sheet of paper or other image receiving member. In one preferred embodiment, the first electric field is an alternating electric field generated by applying an a.c. voltage to the reference electrode and the orifice plate. The second electric field is generated by intermittently applying a d.c. voltage to the projection control electrode at select intervals to selectively project toner particles through the orifice plate. The system can be configured as a full width printing array that includes a series of projection control electrodes and an array of orifices in the orifice plate. Each projection control electrode is aligned with one or more of the orifices in the orifice plate. A control mechanism is used to selectively and intermittently apply a d.c. voltage to the projection control electrodes to project toner through the orifice plate in a predetermined pattern. The control mechanism may include, for example, a series of switches connected between the projection control electrodes and a source of d.c. projection voltage. Alternatively, a pulse generator, or a series of pulse generators, could be used to control the d.c. voltage applied to the projection electrodes.

The toner projection system summarized above can be combined with conventional printer control components to form a direct projection printer. In this embodiment of the invention, the printer includes a formatter that supplies data representing a desired print image to the print engine. The print engine, which is operatively coupled to the formatter, projects an image directly on to the paper. A paper supply mechanism supplies paper to the print engine and a paper output mechanism outputs the printed pages from the print engine. The print engine includes the projector described above—a reference electrode, an orifice plate and a projection control electrode interposed between the reference electrode and the orifice plate. Again, alternating electric field is generated between the reference electrode and the orifice plate to form a cloud of toner particles within the projector. An electric field is generated intermittently between the projection control electrode and the orifice plate to project toner particles through the orifice plate on to a sheet of paper to print the desired image according to the data supplied by the formatter.

DETAILED DESCRIPTION OF THE INVENTION

Figure 1:
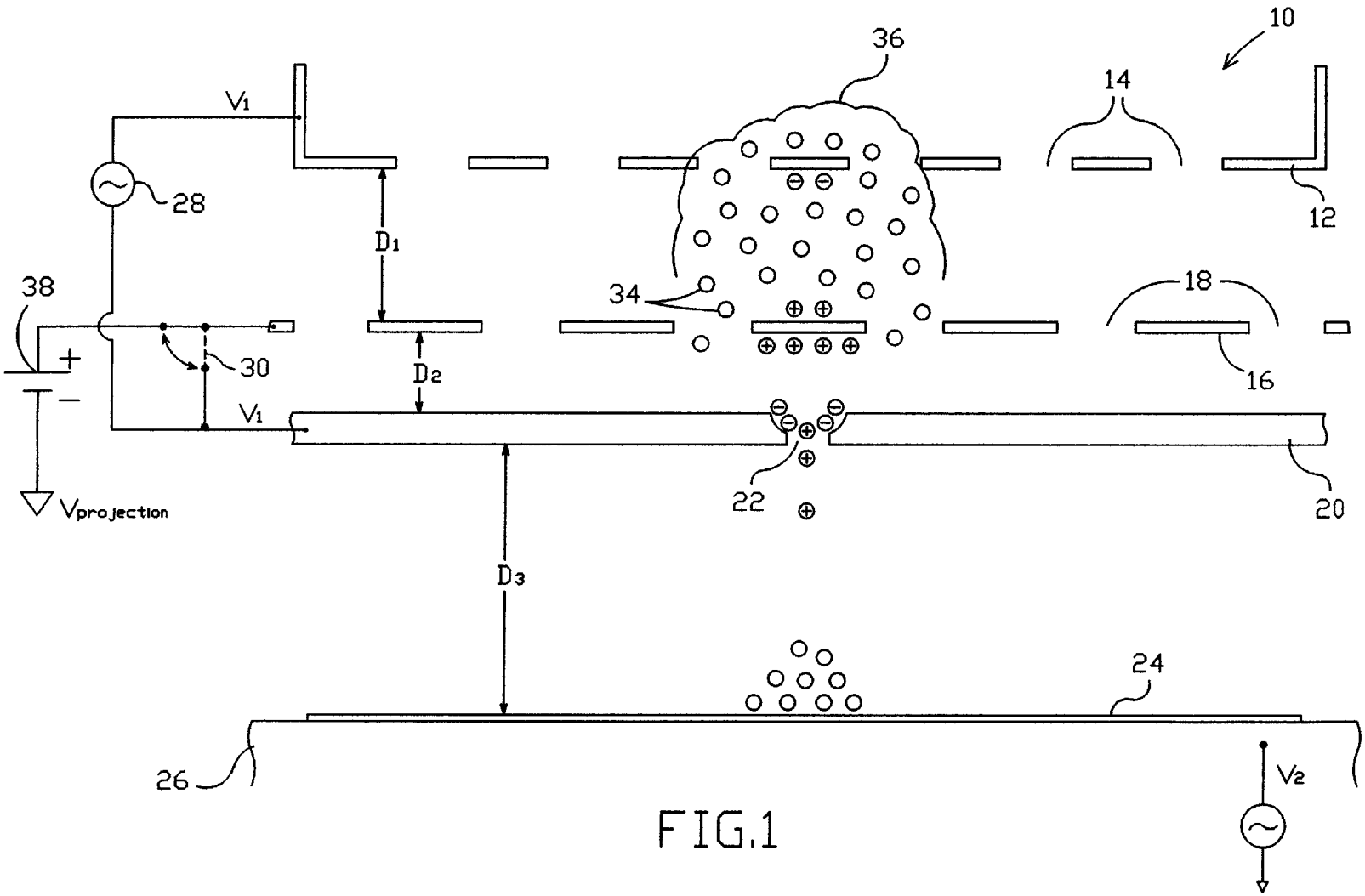
FIG. 1 is a cross-sectional representation of the basic components of a toner projection system that uses a switch to control the application of the projection voltage to the projection control electrode.
Figure 2:
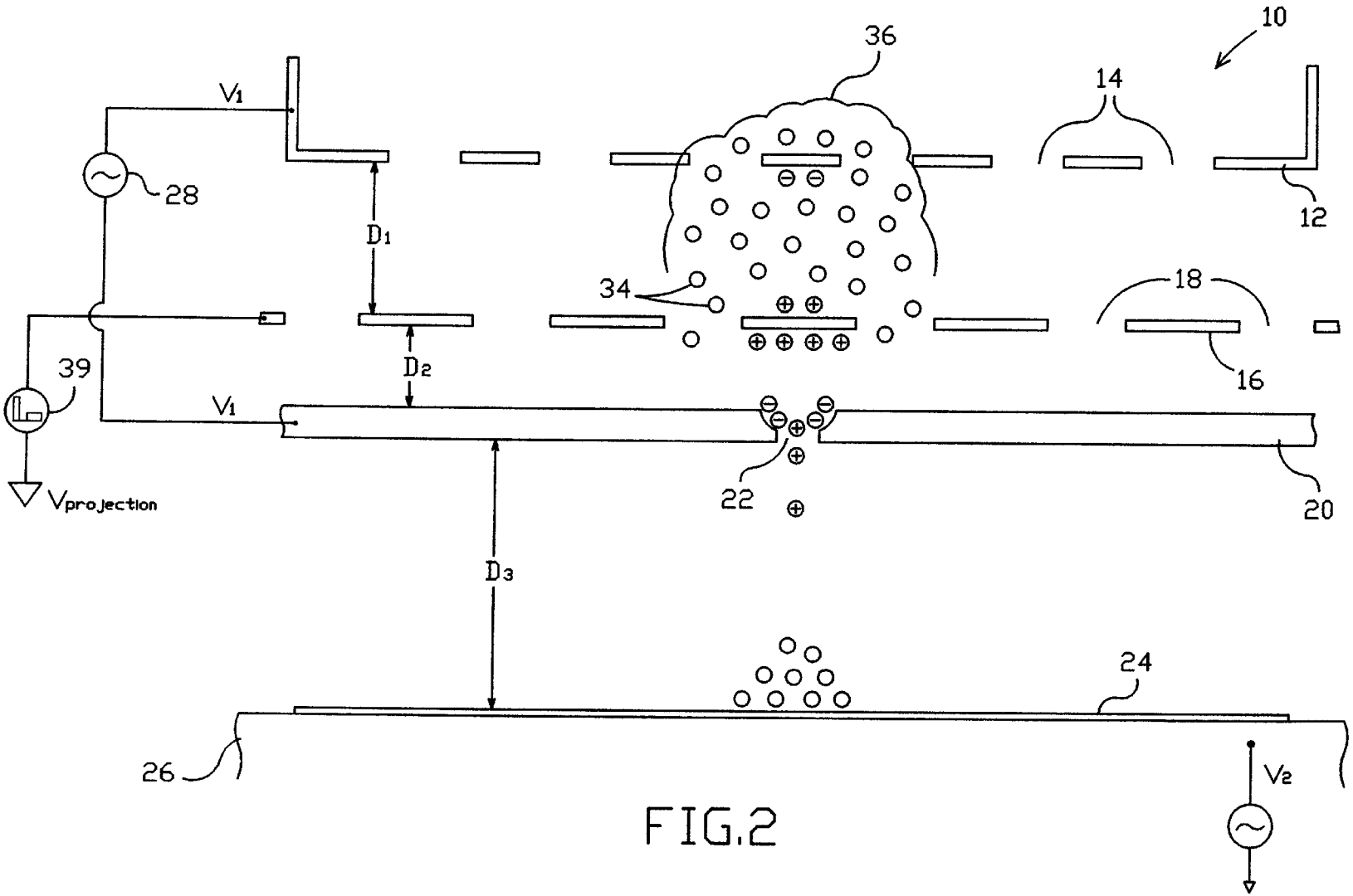
FIG. 2 is a cross-sectional representation of the basic components of a toner projection system that uses a pulse generator to control the application of the projection voltage to the projection control electrode.
Figure 3:
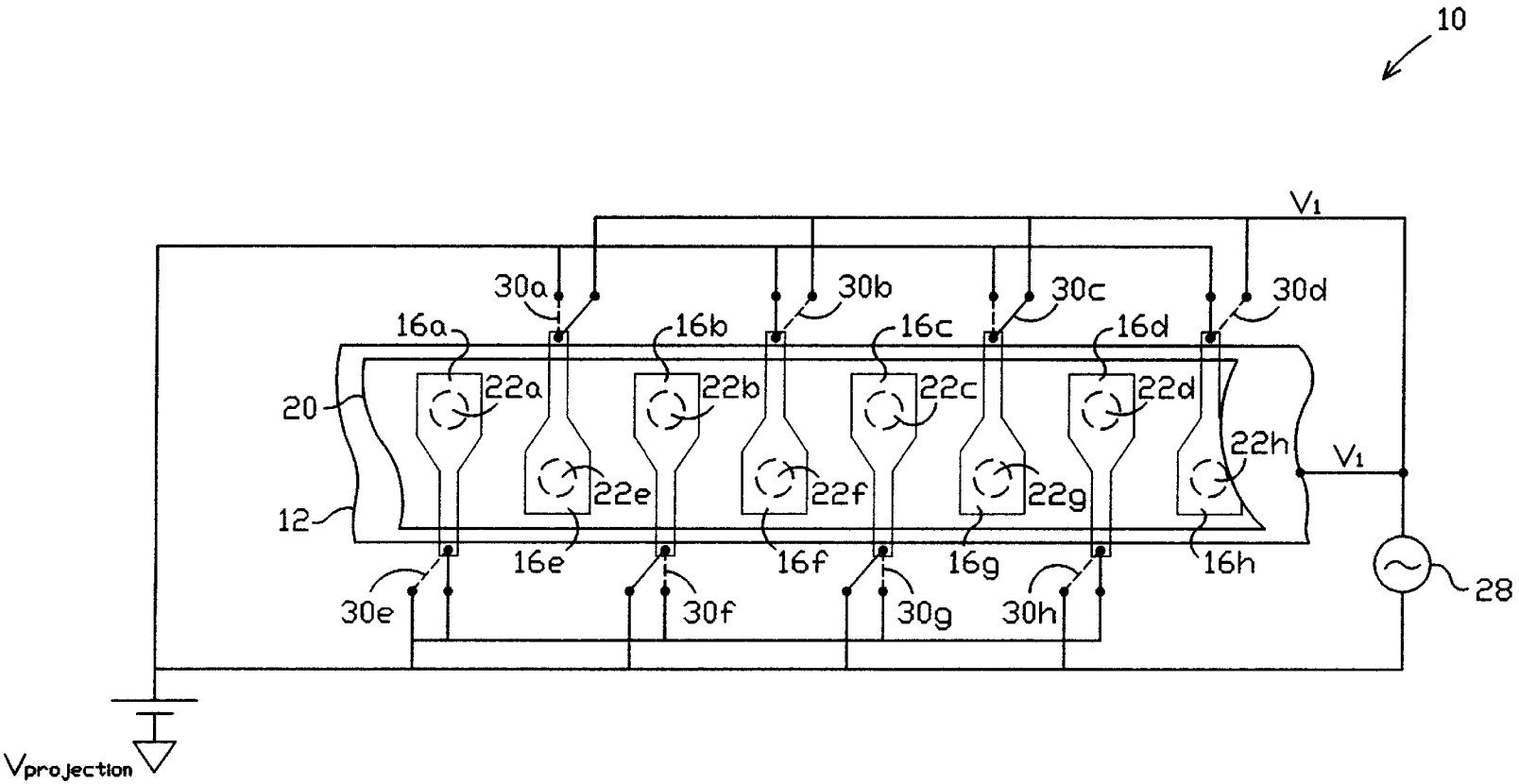
FIG. 3 is a top down plan view of one exemplary configuration of an array of orifices and projection control electrodes.

The basic components of the toner projection system or "projector" are illustrated in FIG. 1. Projector 10 includes a first electrode 12, a second electrode 16, and a third electrode 20. First, second and third electrodes 12, 16 and 20 are also referred to as the reference electrode 12, the projection control electrode 16, and the orifice plate or "printhead" 20. Projection control electrode 16 is positioned between reference electrode 12 and orifice plate 20. Openings 18 in projection control electrode 16 represent either the spacing between discrete electrodes 16, as best seen in FIGS. 2 and 3, or openings through an electrode plate. In either case, openings 18 should not be positioned directly over orifice 22 in orifice plate 20. Optionally, openings 14.are formed in reference electrode 12 so that toner may be introduced into projector 10 either above or below reference electrode 12. Projection control electrode 16 is spaced apart from reference electrode 12 a distance $D_1$. Orifice plate 20 is spaced apart from projection control electrode 16 a distance $D_2$. Paper 24 or other print media is positioned on carrier substrate 26 generally parallel to and spaced apart from orifice plate 20 a distance $D_3$. In a typical projection printing configuration, it is expected that $D_3$ will be about 1 mm. $D_2$ will then be about 0.2 mm to 0.3 mm. $D_1$ is, preferably, somewhat greater than $D_2$.

Reference electrode 12 and orifice plate 20 are connected to a source 28 of voltage $V_1$. Voltage $V_1$ may be an alternating current (a.c.) voltage or a d.c. biased a.c. voltage. In operation, voltage source 28 is turned on to apply voltage $V_1$ to reference electrode 12 and orifice plate 20. In the embodiment illustrated in FIG. 1, voltage $V_1$ is an a.c. voltage. When conductive toner particles contact reference electrode 12 and orifice plate 20, they are charged to the polarity of the voltage applied to those electrodes. The charged toner particles oscillate between the electrodes under the influence of the alternating electric field generated between the first and third electrodes 12 and 20 by application of a.c. voltage $V_1$. Thus, conductive toner particles 34 introduced into the vicinity of reference electrode 12 and orifice plate 20 move alternately between those electrodes and through openings 18 in projection control electrode 16 to form a cloud 36 of toner particles within projector 10. A d.c. projection voltage $V_{PROJECTION}$ is intermittently applied to projection control electrode 16 at select intervals. In the embodiment illustrated in FIG. 1, $V_{PROJECTION}$ is intermittently applied to projection control electrode 16 by opening and closing switch 30. When switch 30 is closed, projection control electrode 16 is connected to source 38 of projection, voltage $V_{PROJECTION}$. When switch 30 is open, projection control electrode 16 is not connected to source 38 of projection voltage $V_{PROJECTION}$. Preferably, projection control electrode 16 is switched between voltage $V_1$ and projection voltage $V_{PROJECTION}$. When projection control electrode 16 is connected to $V_1$, it acts to develop and maintain toner cloud 36 is the manner described above with regard to reference electrode 12 and orifice plate 20. When $V_{PROJECTION}$ is applied to projection control electrode 16, toner particles 34 are projected through orifices 22 onto paper 24. In an alternative embodiment illustrated in FIG. 2, a pulse or signal generator 39 is used to intermittently apply the d.c. voltage to projection control electrode 16. Switch 30 and source 38 in FIG. 1 and pulse generator 39 in FIG. 2 serve as a mechanism for intermittently applying a d.c. voltage to projection control electrode 16. Each of these mechanisms can be electronically controlled or programmed to apply a d.c. voltage to the projection electrode at select intervals to achieve the desired print pattern. Other suitable control mechanisms could also be used.

The magnitude of projection voltage $V_{PROTECTION}$ is greater than the magnitude of voltage $V_1$. It is expected that, in a typical printing application, the voltage differential between $V_{PROTECTION}$ and $V_1$ will be about 200 volts. Projection voltage $V_{PROTECTION}$ is applied for a time period longer than 1/frequency of the a.c. voltage $V_1$. Projection voltage $V_{PROTECTION}$ can be either polarity when $V_1$ is an a.c. voltage. For example, when $V_{PROTECTION}$ is positive, as shown in FIG. 1, toner particles in contact with projection control electrode 16 become positively charged. Having thus acquired a positive charge, the toner particles in contact with projection control electrode 16 are repelled from that electrode and attracted to orifice plate 20 due to the electric field that exists during the time period when orifice plate 20 is negative or opposite to the polarity of projection voltage $V_{PROTECTION}$. In this way, toner particles above and adjacent to orifice 22 are projected through orifice 22 on to paper 24.

The charge on the toner particles will, due to the particles' conductivity, dissipate as the particles contact paper 24, and thereby reduce or eliminate counter-electrostatic field forces that would be significant when using insulative toners. If desired, a voltage $V_2$ having a polarity opposite the polarity of voltage $V_{PROTECTION}$ may be applied to carrier substrate 26 to assist in the toner projection trajectory onto the print media. Thereafter, the toner can be fused to the paper using conventional methods and devices well known to those skilled in the art. Application of an a.c. voltage (voltage $V_1$) also helps clean the face of the printhead, orifice plate 20, due to the vibration created by the a.c. voltage.

The velocity of the conductive toner particles moving from projection control electrode 16 toward orifice plate 20, some of which are projected through orifice 22 upon application of projection voltage $V_{PROTECTION}$, is determined according to Equation No. 1. Conductive toner particles, as that term is used in this specification and in the claims, includes conductive and semi-conductive, preferably dry, toner particles. The degree of conductivity of the toner particles may be varied as necessary to achieve the desired operating parameters for projector 10, as described in more detail below.

$$v_t=\sqrt{2(Q/m)\Delta V(1-e^{-Tm/Tt})} \qquad \text{Equation No. 1}$$

where:

$v_t$=velocity of toner particle (meters/sec.)

$\Delta V=V_{PROTECTION}-V_1$ (volts)

Q=toner charge (coulombs)=$4\pi\in_0 r^2 E_{CRITICAL}$ m=toner mass (grams)=$(4/3)\pi r^3\rho_t$ $T_m$=mechanical contact time constant (sec.)

$T_t$=toner charge transfer time constant (sec.)=$k_t\in_0 p_t$ $\rho_t$=toner resistivity (ohm cm)

$k_t$=dielectric constant $\in_0$=permitivity of free space=$8.85\times10^{-14}$ farads/cm r=toner radius (cm)

$E_{CRITICAL}$=electrostatic field=$30\times10^3$ volts/cm $\rho_t$=toner density (gram/cm$^3$)

Optimization of projector 10 can be achieved according to Equation No. 1 by varying the characteristics of the toner, the magnitude and polarity of the voltages applied to the electrodes and the distances $D_1$, $D_2$, between electrodes 12, 16 and 20 and distance $D_3$ between orifice plate 20 and paper 24. For example, a suitable mono-component conductive dry toner particle may have a radius, r, of approximately $5\times10^{-4}$ cm and a density, $\rho_t$, of approximately 1 gram/cm$^3$. Preferably, such toner will be made to have a resistivity of about $10^4$ ohm-cm. A 200 volt voltage differential applied between the second and third electrodes 16, 20 will project such toner particles through orifice 22 at a velocity of approximately 2.52 m/sec. This velocity is sufficient to project the toner particles on to paper 24 up to a distance $D_3$ of approximately 1 mm. The preferred range of conductivity of the toner particles, as measured by its resistivity, is $10^4$ ohm-cm to $10^{10}$ ohm-cm.

Figure 4:
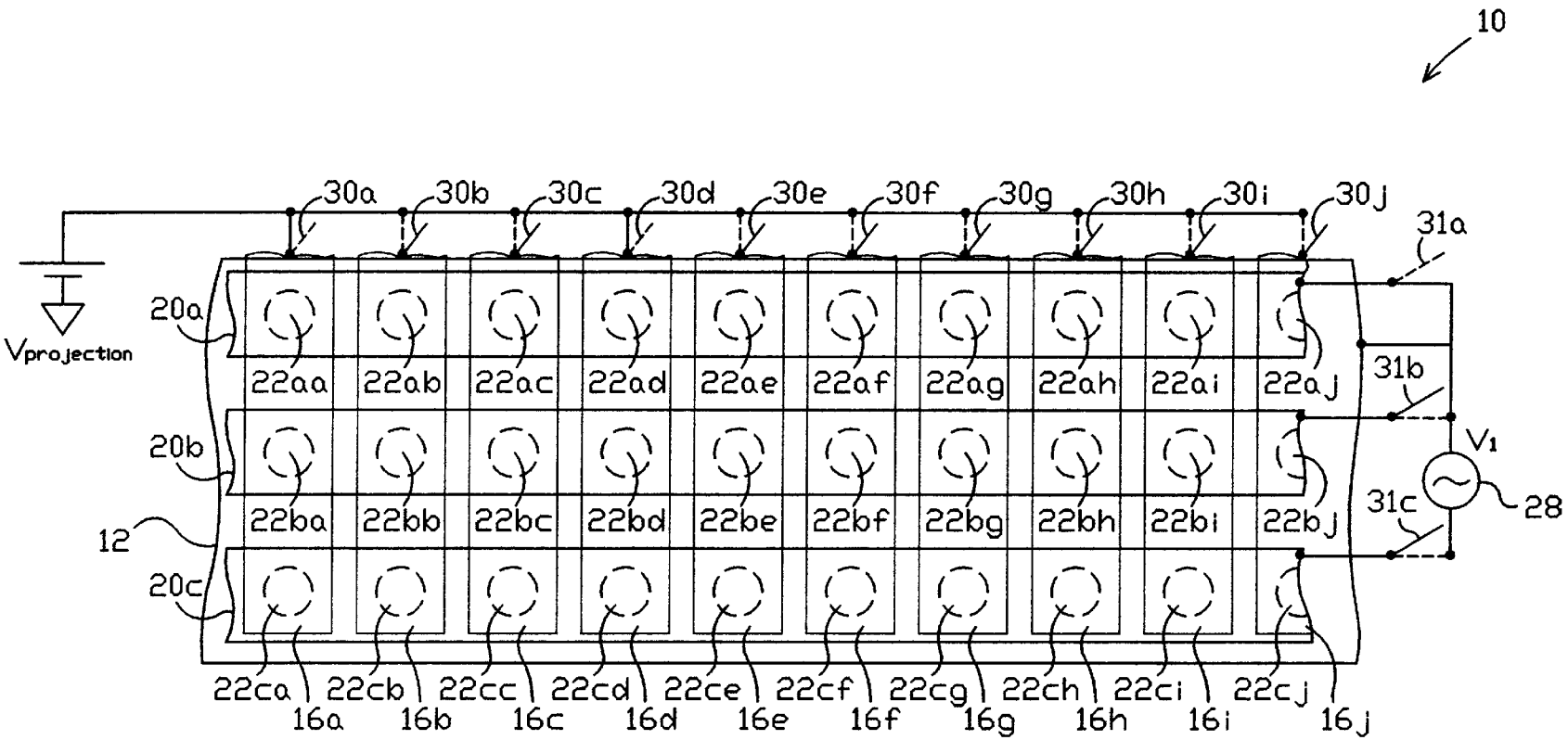
FIG. 4 is a top down plan view of a second exemplary configuration of an array of orifices and projection control electrodes.

FIGS. 3 and 4 show two exemplary configurations for an array of projection control electrodes 16 and orifice plates 20 such as might be used in a direct projection electrostatic printer. In FIG. 3, projector 10 includes a series of discrete projection control electrodes 16*a*–16*h* positioned over orifices 22*a*–22*h* in orifice plate 20. Each projection control electrode is connected alternately to $V_1$ or $V_{PROTECTION}$ through switches 30*a*–30*h*. The desired image is obtained by projecting toner particles through individual orifices in a predetermined. pattern or sequence by controlling the application of $V_{PROTECTION}$ to projection control electrodes 16*a*–16*h* through switches 30*a*–30*h*, or through another suitable control mechanism as described above. In the array shown in FIG. 4, orifice plate 20 consists of three parallel plates 20*a*–20*c*. Orifice plates 20*a*–20*c* are connected to $V_1$ through switches 31*a*–31*c*. Each projection control electrode 16*a*–16*j* covers a series of orifices 22*a, b* and *c* across the three orifice plates. Toner is projected through an individual orifice by simultaneously applying voltage $V_1$ to the proper orifice plate and $V_{PROTECTION}$ to the overlying projection control electrode. For example, toner is projected through orifices 22*aa* and 22*ad* in orifice plate 20*a* by applying $V_1$ to orifice plate 20*a* and simultaneously applying $V_{PROTECTION}$ to projection control electrodes 16*a* and 16*d*, as shown by the switching configuration in FIG. 4. Thus, in this configuration the desired image is projected onto the paper by simultaneously controlling the application of $V_1$ to orifice plates 20*a*–20*c* through switches 31*a*–31*c* and $V_{PROTECTION}$ to projection control electrodes 16*a*–16*j* through switches 30*a*–30*j*.

Figure 5:
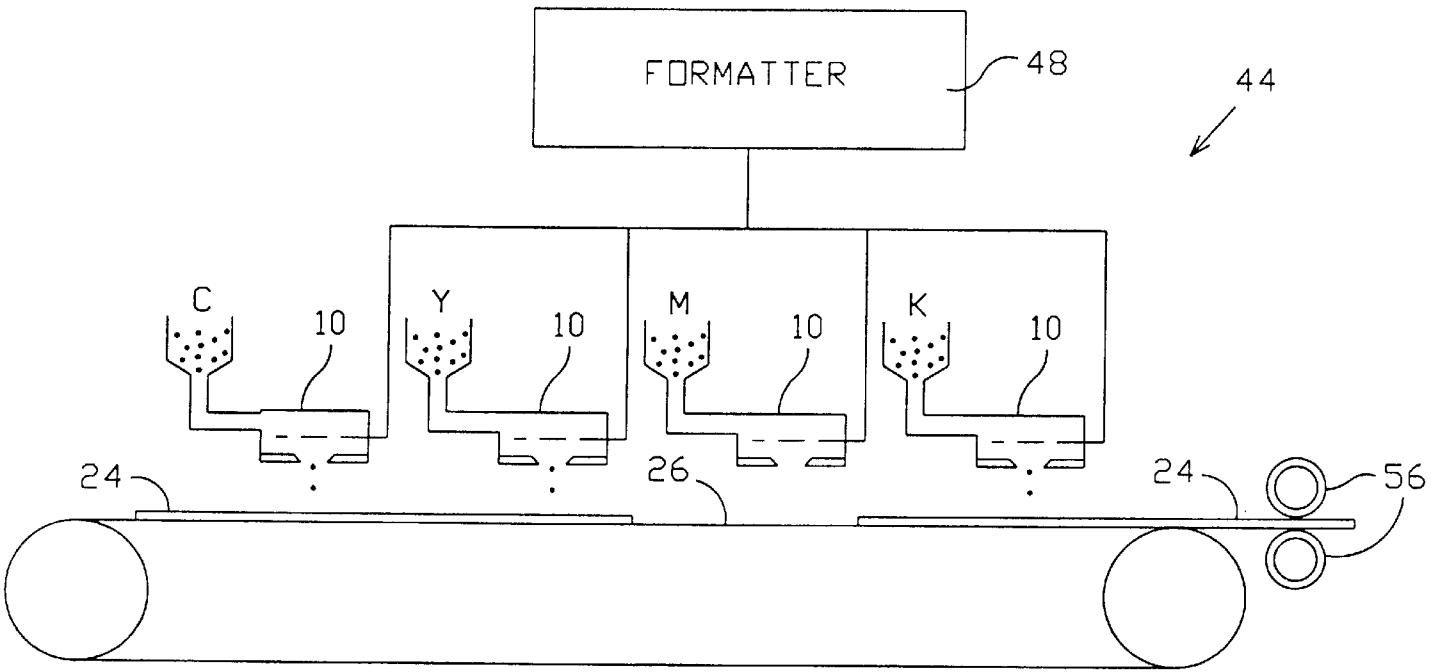
FIG. 5 is a diagrammatic representation of a direct electrostatic projection printer.

Projector 10 can be combined with conventional printer control components to form an image forming apparatus for printing on a page of paper or other print media. Such an image forming apparatus is illustrated schematically in FIG. 5 as an in line color printer 44. Referring to FIG. 5, a plurality of color toner projectors 10 are positioned longitudinally adjacent to one another above paper carrier substrate 26. Alternatively, a single projector 10 could be incorporated into a monochrome printer. A formatter mechanism 48 is operatively coupled to projectors 10. Formatter 48 supplies projectors 10 with data representing the desired image to be printed on the pages of paper 24. In this embodiment of the invention, projectors 10 include an array of independently controlled projection control electrodes that extend across paper 24 such as that illustrated in FIG. 3. Projection voltages are selectively applied to the projection control electrodes according to the data supplied by formatter 48 so that the toner particles are projected at desired locations on paper 24.

Pages of paper 24 are transported along and below projectors 10 on a transport belt or other suitable paper carrier substrate 26. The partial color image in each of the black (K), magenta (M), yellow (Y) and cyan (C) color planes are successively and sequentially projected on to the surface of paper 26 through projectors 10. Thereafter, paper 24 passes between a set of fuse rollers 56 to permanently affix the toner image on the paper. Formatter 48, carrier substrate 26 and fuse rollers 56 are intended to represent generally the various conventional printer components suitable for electronically formatting the desired image, supplying paper to the print engine (projectors 10) and affixing the toner image on the paper, respectively.

There has been shown and described a novel system for projecting conductive or semi-conductive toner directly on to print media. The direct projection of conductive or semi-conductive toner using the invented projection system is expected to help reduce the degradation of print quality caused by counter-electrostatic field forces that divert toner trajectories in conventional print mechanisms—forces that are particularly evident in dry toner color printers. The invented system allows for the elimination of the toner development and photoconductive drum components used in conventional printers and, should, therefore, reduce the cost of the printer. The apparatus and method of the present invention should also eliminate problems caused by "wrong sign" toner and make the print process less sensitive to varying levels of paper resistivity. Various modifications may be made to the above described embodiments of the invention by those skilled in the art without departing from the spirit and scope of the invention as set forth in the appended claims.

What is claimed is:

1. A toner projection device, comprising:

(a.) a first electrode;

(b.) a second electrode;

(c.) a third electrode;

(d.) an orifice in the third electrode;

(e.) the second electrode interposed between the first and third electrodes and the second electrode at least partially spanning the orifice in the third electrode;

(f.) a source of a.c. voltage operatively connected to the first and third electrodes;

(g.) a control means for intermittently applying a d.c. voltage to the second electrode.

2. The device of claim 1, wherein the control means comprises:

(a.) a source of d.c. voltage; and (b.) a switch operatively connected between the second electrode and the source of d.c. voltage, the switch operative between a first position wherein the second electrode is electrically connected to the source of d.c. voltage and a second position wherein the second electrode is not electrically connected to the source of d.c. voltage.

3. The device of claim 1, wherein the control means comprises a pulse generator operatively connected to the second electrode.

4. The device of claim 1, wherein the magnitude of the d.c. voltage is greater than the magnitude of the a.c. voltage.

5. The device of claim 1, wherein the d.c. voltage is applied to the second electrode at select intervals for a time period longer than 1/frequency of the a.c. voltage applied to the first and third electrodes.

6. The device of claim 1, wherein the electrodes are configured with respect to one another so that toner particles are free to move between the first and second electrodes and between the second and third electrodes.

7. The device according to claim 6, wherein the first and second electrodes define a first space therebetween in which toner particles may move and the second and third electrodes define a second space therebetween in which toner particles may move.

8. A toner projection device, comprising:

(a.) a first electrode;

(b.) a plurality of second electrodes;

(c.) a third electrode;

(d.) a plurality of orifices in the third electrode;

(e.) the second electrodes interposed between the first and third electrodes and each of the second electrodes at least partially spanning an orifice in the third electrode;

(f.) a source of a.c. voltage operatively connected to the first and third electrodes;

(g.) a control means for intermittently applying a d.c. voltage to the second electrodes.

9. The device of claim 8, wherein the control means comprises:

(a.) a source of d.c. voltage; and (b.) a plurality of switches operatively connected between corresponding ones of the second electrodes and the source of d.c. voltage, each switch operative between a first position wherein the corresponding second electrode is electrically connected to the source of d.c. voltage and a second position wherein the corresponding second electrode is not electrically connected to the source of d.c. voltage.

10. The device of claim 8, wherein the magnitude of the d.c. voltage applied to each of the second electrodes is greater than the magnitude of the a.c. voltage.

11. The device of claim 8, wherein the d.c. voltage is applied to each of the second electrodes at select intervals for a time period longer than 1/frequency of the a.c. voltage applied to the first and third electrodes.

12. The device of claim 8, wherein the electrodes are configured with respect to one another so that toner particles are free to move between the first and second electrodes and between the second and third electrodes.

13. The device according to claim 12, wherein the first and second electrodes define a first space therebetween in which toner particles may move and the second and third electrodes define a second space therebetween in which toner particles may move.

14. A toner projection device, comprising:

first, second and third electrodes, the second electrode interposed between the first and third electrodes, the first and second electrodes defining a first space therebetween in which toner particles may move and the second and third electrodes defining a second space therebetween in which toner particles may move;

an orifice in the third electrode;

a source of A.C. voltage operatively connected to the first and third electrodes; and a control means for intermittently applying a D.C. voltage to the second electrode, wherein the second electrode spans the orifice in the third electrode.

* * * * *